US009386821B2

(12) United States Patent
Lambertz

(10) Patent No.: US 9,386,821 B2
(45) Date of Patent: Jul. 12, 2016

(54) SOLE

(75) Inventor: Bodo W. Lambertz, Pfaffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 509 days.

(21) Appl. No.: 13/512,664

(22) PCT Filed: Nov. 30, 2010

(86) PCT No.: PCT/EP2010/007243

§ 371 (c)(1),
(2), (4) Date: May 30, 2012

(87) PCT Pub. No.: WO2011/063985

PCT Pub. Date: Jun. 3, 2011

(65) Prior Publication Data

US 2012/0240432 A1 Sep. 27, 2012

(30) Foreign Application Priority Data

Nov. 30, 2009 (DE) ..... 20 2009 016 139

(51) Int. Cl.

| | |
|---|---|
| ***A43B 3/12*** | (2006.01) |
| ***A43B 13/14*** | (2006.01) |
| ***A43C 15/14*** | (2006.01) |
| ***A43C 15/08*** | (2006.01) |
| ***A43B 7/14*** | (2006.01) |

(52) U.S. Cl.

CPC ..... *A43B 13/14* (2013.01); *A43B 7/146* (2013.01); *A43C 15/08* (2013.01); *A43C 15/14* (2013.01)

(58) Field of Classification Search

CPC ..... A43B 13/14; A43B 7/146; A43C 15/14; A43C 15/08; A43C 15/066; A43C 15/168; A43C 15/065

USPC ..... 36/61, 59 R, 134, 62, 67 C, 67 D

See application file for complete search history.

(56) References Cited

U.S. PATENT DOCUMENTS

| | | | | | |
|---|---|---|---|---|---|
| 2,114,089 | A * | 4/1938 | Trick et al. | ..... | 36/156 |
| 2,183,197 | A * | 12/1939 | Kohlruss | ..... | 36/157 |
| 3,757,774 | A * | 9/1973 | Hatuno | ..... | 601/28 |
| 4,271,608 | A * | 6/1981 | Tomuro | ..... | 36/61 |
| 4,598,484 | A * | 7/1986 | Ma | ..... | 36/3 R |
| 5,289,647 | A * | 3/1994 | Mercer | ..... | 36/134 |
| 5,351,422 | A * | 10/1994 | Fitzgerald | ..... | 36/134 |
| 5,634,283 | A * | 6/1997 | Kastner | ..... | 36/61 |
| 5,682,690 | A * | 11/1997 | Chang | ..... | 36/141 |
| 5,732,482 | A * | 3/1998 | Remington et al. | ..... | 36/61 |
| 6,689,077 | B2 * | 2/2004 | Dabir | ..... | 601/136 |
| 6,715,221 | B1 * | 4/2004 | Sasaki | ..... | 36/141 |
| 6,915,595 | B2 * | 7/2005 | Kastner | ..... | 36/59 R |
| 7,926,205 | B2 * | 4/2011 | ÅMark | ..... | 36/61 |
| 8,607,477 | B2 * | 12/2013 | ÄMark | ..... | 36/61 |
| 2006/0016101 | A1 * | 1/2006 | Ungari | ..... | 36/61 |
| 2006/0021254 | A1 * | 2/2006 | Jones | ..... | 36/61 |
| 2008/0010868 | A1 * | 1/2008 | Tsai | ..... | 36/141 |
| 2008/0184594 | A1 * | 8/2008 | Ebeling | ..... | 36/11.5 |
| 2008/0271341 | A1 * | 11/2008 | Amark | ..... | 36/61 |

FOREIGN PATENT DOCUMENTS

WO WO 2007/037731 A1 4/2007

* cited by examiner

*Primary Examiner* — Jila M Mohandesi
(74) *Attorney, Agent, or Firm* — Olson & Cepuritis, Ltd.

(57) ABSTRACT

A sole for footwear having a core layer which is provided with openings and pins that are moveably guided through the openings. The pins protrude outside a top and a bottom of the core layer and are intended to transfer the contour of the ground to the bottom of a user's foot as the user moves.

3 Claims, 2 Drawing Sheets

SOLE

Figure 1:
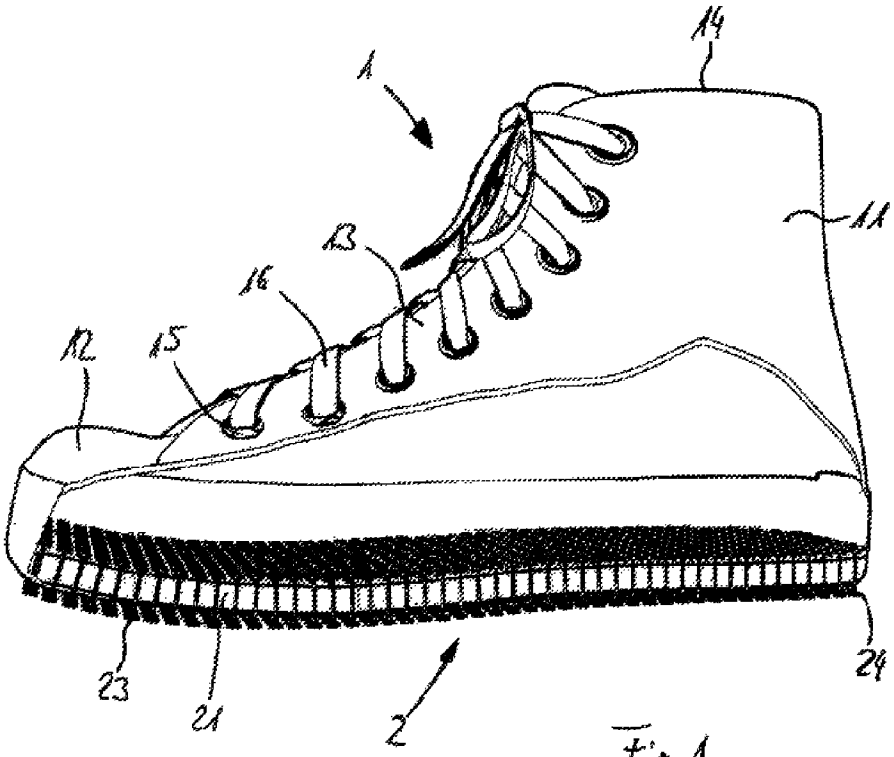

Soles for shoes, boots, sandals or the like are known in designs of the greatest variety. For example, designs exist that are particularly shock absorbing, to enable a high degree of damping during sports activities, which reduces the loads on the joints of the athletes. In addition, particularly stable soles are known, which are used, for example, in work shoes or hiking shoes, to protect the foot and at the same time provide a high measure of skid resistance and of impermeability. Solid leather soles are also known, which are used in particular in normal footwear.

All the mentioned shoe soles have in common that they provide a high degree of support for the foot. This has the consequence that the foot itself is exposed to no movements at all, except for the roll over motion. In particular, the irregularities of the ground are not transferred to the foot due to the soles. Rather, the foot is rigidly uncoupled from the irregularities of the ground.

The above properties of soles are in contradiction with the recommendations of physicians and physical therapists. Orthopedists in particular frequently recommend walking barefoot as a component of a healthy lifestyle. Indeed, walking barefoot leads to a strengthening of the foot musculature, and it results in a correct toe position. This reduces, for example, the risk of foot damage, particularly fallen arches, splayfoot, or flat feet. The reason for this is that the feet and the vertebral column form a functional unit while walking. Thus, the foot musculature which has been conditioned by regular barefoot walking acts as a shock absorber, which is highly beneficial to the intervertebral disks, among other factors. When walking barefoot, the foot is forced to permanently compensate for irregularities of the ground, which results in the numerous muscles in the foot being trained. The soles that are usually used in shoes, boots, sandals and the like impede this freedom of movement, which is instead greatly limited because of the soles, resulting in the atrophy of the foot musculature. However, walking barefoot is not always possible due to societal conventions, on the one hand, and to environmental conditions, on the other hand.

Consequently, the aim of the present invention is to provide a sole for shoes, boots, sandals and the like, which, on the one hand, offers the known advantages of soles, and on the other hand, confers to the foot the same sensation as associated with barefoot walking According to the invention, this problem is solved by a sole for shoes, boots, sandals or the like, which comprises a core layer which is provided in at least some areas with openings in which pins are moveably guided.

The invention provides a sole that confers to the foot the sensation of walking barefoot. As a result, a continuous training of the foot musculature occurs. This is made possible by the movable pins arranged in the sole. During the action of walking, the pins reproduce the irregularities of the floor, transferring them to the feet. Consequently, the sensation of wearing the soles according to the invention is similar to the sensation of walking barefoot.

In a variant of the invention, the pins are spring mounted. Although the spring mount of the pins offers the advantage of completely transferring the irregularities to the foot, resulting in the barefoot sensation, this is achieved only by the damping of the motion of the pins. As a result, the comfort while walking on the soles according to the invention is further increased.

The pins are provided advantageously with plates on at least one end. Due to the plates, a larger surface area of application on the foot and/or the ground is possible, so that the entire surface of the sole can be covered using a smaller number of pins.

In an embodiment of the invention, the pins are always provided with a piston. The piston can be used, on the one hand, as application surface in the case of a spring mount, and, on the other hand, it can provide a guide for the pins.

The pistons are advantageously guided in chambers that are part of the openings. Due to the design of the chambers, it is possible, for example, to fill the piston with an incompressible medium, which also results in a damping effect.

A base layer is preferably arranged on the core layer. The base layer is used to keep soiling and moisture away from the core layer. Consequently, the sole is as easy to maintain as the known soles.

It is most preferred to arrange an inner layer on the core layer. The use of the inner layer in addition increases the wearer comfort. For example, as the inner layer, an antibacterial and actively breathing material can be used, which prevents fungal diseases of the foot, and can improve the climate in the shoe.

Figure 2:
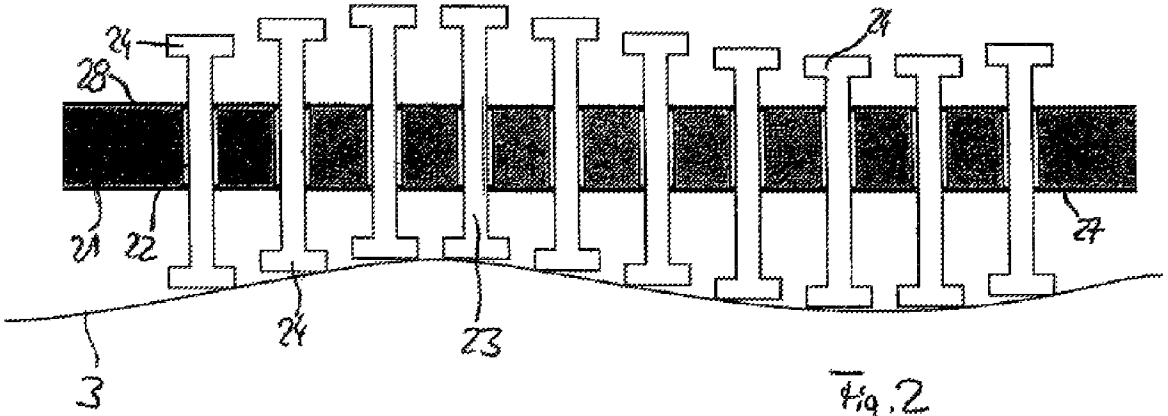
Figure 3:
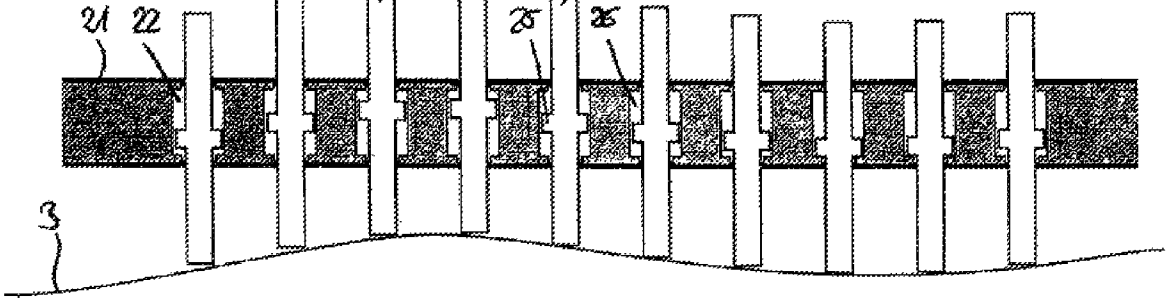

Additional variants and embodiments of the invention are indicated in the remaining dependent claims. An embodiment example of the invention is represented in the drawing, and described in further detail below. The figures show:

FIG. 1 the representation of a shoe, partially in cross section, and partially in view;

FIG. 2 the detail representation of the sole according to the invention, and FIG. 3 the detail representation of the sole according to the invention in another embodiment.

The shoe selected as embodiment example consists of an upper component 1 and of a sole 2. The upper component 1 consists of a shaft 11 which extends in the area of the forefoot to a cap piece 12. From the cap piece 12, a strap 13 starts, which extends at least to the margin 14 of the upper component 1. In the strap 13, holes 15 are provided, through which a shoe lace 16 is led, which is used to tie the shoe. The upper component 1 can be made of plastic or reinforced plastic fibers.

The sole 2 consists of a core layer 21 which is made of plastic. The sole 2 is provided with openings 22 in which the pins 23 are moveably guided. The combination of the openings 22 with the pins 23 allows a movement along the longitudinal center line of the openings 22. The pins 23 are made of plastic in the embodiment example. The use of other materials, such as, for example, metal, rubber or the like is also possible.

In the embodiment example according to FIG. 2, the pins 23 are each provided at their two ends with plates 24. By means of the plates 24, the application surface of the pins 23 is enlarged. They function as a result like a stamp. In the embodiment example according to FIG. 3, the pins are provided with pistons 25. In the embodiment example, the piston 25 is approximately in the center of the pins 23. The pistons 25 are guided in chambers 26 which are part of the openings 22 of the core layer 21. The chambers 26 can be filled with an incompressible medium. As a result, damping occurs in case of a motion of the pins 23.

A bottom layer 27 is arranged on the core layer 21. The bottom layer 27 seals the core layer 21 and thus the sole 2 from the ground. In this manner, soiling or moisture is prevented from penetrating into the openings 22. On the inner side of the shoe, an inner layer 28 is arranged on the core layer 21. The inner layer 28 is preferably made of a skin compatible material, for example, an antibacterial material.

In FIGS. 2 and 3, in which details of the sole 2 are represented in two different embodiments, the ground 3 is also represented diagrammatically. Given the wavy course of the ground 3, one can see how the sole according to the invention functions. Due to the pins 23 which are movably arranged in the sole 2, the surface contour of the ground 3 is reproduced on the inner side of the sole. Therefore, a contour is transferred to the foot, as it would be felt by the foot without a shoe when walking on the given ground. Consequently, the muscles in the foot are excited as they would also be when walking barefoot. Thus, a continuous training of the muscles occurs, so that the use of the sole according to the invention produces the health benefits of walking barefoot while at the same time protecting against cold, soiling, moisture and the like. The invention thus combines the advantage of barefoot walking with the advantages of using shoes.

In a variant of the embodiment example, it is also possible to arrange a flexible outsole or a flexible innersole on the pins, so that the pins themselves are completely covered by said soles. In this case, the entire mechanism of the sole consisting of the core layer 21 is covered completely by the pins 23 in any embodiment. All that is needed to achieve this is that the respective innersoles or outsoles have sufficient flexibility to be able to reproduce the motions of the pins.

To the extent that the invention in the embodiment example is explained in reference to an ankle-high shoe, this does not limit the scope of protection of the invention to this design; rather, other footwear in the form of sandals, boots, loafers, sneakers or the like is also included in the scope of protection of the invention.

The invention claimed is:

1. Footwear to be worn by a user when moving on the ground comprising:

an upper portion connected to a sole thereby defining an internal area designed to fit the foot of the user;

the sole comprising a core between a top surface and a bottom surface, and a plurality of spaced apart apertures extending through the core between the top surface and the bottom surface;

a plurality of pins, each pin having a body between a first end and a second end wherein the pins are moveably guided through the apertures of the sole such that the first end of the pins extends out of the top surface into the internal area and the second end of the pins extends out of the bottom surface;

wherein the apertures have a first diameter at the top surface and a second diameter at the bottom surface and further comprises a chamber extending partially between the top surface and the bottom surface wherein the chamber has a third diameter that is greater than the first and second diameters; and wherein the first end of the pins are adapted to communicate with a bottom of a foot of the user in response to the second end of the pins communicating with the ground.

2. The footwear of claim 1 wherein the body of the pins further comprises a piston sized to cooperate within the chamber.

3. The footwear of claim 1 wherein the chambers are filled with an incompressible medium.

* * * * *